US008742335B2

(12) United States Patent
Bell et al.

(10) Patent No.: US 8,742,335 B2
(45) Date of Patent: Jun. 3, 2014

(54) ROTATOR SAMPLE INTRODUCTION INTERFACE

(75) Inventors: Ryan J. Bell, Pinellas Park, FL (US); R. Timothy Short, St. Petersburg, FL (US); Strawn K. Toler, Bradenton, FL (US); Friso H. W. van Amerom, St. Pete Beach, FL (US)

(73) Assignee: SRI International, Menlo Park, CA (US)

( * ) Notice: Subject to any disclaimer, the term of this patent is extended or adjusted under 35 U.S.C. 154(b) by 317 days.

(21) Appl. No.: 12/971,115

(22) Filed: Dec. 17, 2010

(65) Prior Publication Data

US 2011/0147580 A1 Jun. 23, 2011

Related U.S. Application Data

(60) Provisional application No. 61/288,217, filed on Dec. 18, 2009.

(51) Int. Cl.
*H01J 49/04* (2006.01)

(52) U.S. Cl.
CPC ..... *H01J 49/0431* (2013.01)
USPC ..... 250/288

(58) Field of Classification Search
USPC ..... 250/288; 73/863–864.91
See application file for complete search history.

(56) References Cited

U.S. PATENT DOCUMENTS

| | | | | |
|---|---|---|---|---|
| 4,988,879 | A * | 1/1991 | Zare et al. | 250/423 P |
| 5,294,797 | A * | 3/1994 | Frey et al. | 250/427 |
| 5,701,762 | A * | 12/1997 | Akamatsu et al. | 62/636 |
| 6,855,925 | B2 * | 2/2005 | Ellson et al. | 250/288 |
| 2001/0038071 | A1 * | 11/2001 | Nichols et al. | 250/288 |
| 2010/0024527 | A1 * | 2/2010 | LaMarr et al. | 73/61.56 |

OTHER PUBLICATIONS

Orsnes et al., "Measurement of Inorganic Acids with Rotating Ball Inlet Mass Spectrometry" Anayltica Chimica Acta 390 (1999) pp. 185-192.

Schmidt et al., "Monitoring Organic Compounds in Aqueous Solution by Rotating Ball Inlet Mass Spectrometry with Continuous Wave Infrared Laser Desorption" Sensors and Actuators B76 (2001) pp. 411-418.

Orsnes et al., "Rotating Ball Inlet for Continuous Mass Spectrometric Monitoring of Aqueous Solutions" Rapid Communications in Mass Spectrometry, vol. 12, pp. 11-14 (1998).

* cited by examiner

*Primary Examiner* — Michael Logie
*Assistant Examiner* — Eliza Osenbaugh-Stewart

(57) ABSTRACT

In one embodiment, the present invention relates generally to a rotator sample introduction interface. In one embodiment, the rotary interface for collecting an analyte includes a valve body, a rotor coupled to the valve body and a stator coupled to the rotor. In one embodiment, the rotor is channel-free and the stator includes a first channel and a second channel, wherein the first channel comprises an inlet for receiving a liquid and an outlet for expelling the liquid, wherein a carrier gas is provided via an inlet of the second channel and an outlet of the second channel is coupled to an analyzer.

18 Claims, 6 Drawing Sheets

ROTATOR SAMPLE INTRODUCTION INTERFACE

RELATED APPLICATIONS

This application claims priority under 35 U.S.C. §119(e) to U.S. provisional patent application Ser. No. 61/288,217, filed on Dec. 18, 2009, which is hereby incorporated by reference in its entirety.

BACKGROUND OF THE INVENTION

Over the course of many years, various corporations and the United States government have dumped various pollutants into the ocean or other various bodies of water. These pollutants in the water can pose human health and safety risks and an environmental hazard. This could lead to economic effects and potential damage to marine resources.

As a result, there is a need for underwater mass spectrometry to monitor these marine environments. Current underwater mass spectrometers typically use a membrane interface. However, membrane interfaces have limited detection capabilities. For example, membrane interfaces can only allow detection of relatively volatile, non-polar compounds. This limits the number of chemical classes that can be detected by an underwater mass spectrometer that uses a membrane.

SUMMARY OF THE INVENTION

In one embodiment, the present disclosure is directed towards a rotator sample introduction interface. In one embodiment, the rotary interface for collecting an analyte comprises a valve body, a rotor coupled to the valve body, wherein the rotor is channel-free and a stator coupled to the rotor, wherein the stator comprises a first channel and a second channel, wherein the first channel comprises an inlet for receiving a liquid and an outlet for expelling the liquid, wherein a carrier gas is provided via an inlet of the second channel and an outlet of the second channel is coupled to an analyzer.

In one embodiment, the present disclosure is directed towards a system for performing underwater mass spectrometry. The system for performing underwater mass spectrometry comprises an underwater mass spectrometer and a rotary interface coupled to the underwater mass spectrometer. The rotary interface comprises a valve body, a rotor coupled to the valve body, wherein the rotor is channel-free and a stator coupled to the rotor, wherein the stator comprises a first channel and a second channel, wherein the first channel comprises an inlet for receiving a liquid and an outlet for expelling the liquid, wherein a carrier gas is provided via an inlet of the second channel and an outlet of the second channel is coupled to an analyzer.

In one embodiment, the present invention is directed towards a method for collecting an analyte underwater. The method comprises receiving water via an inlet of a first channel of a stator, adsorbing the analyte from the water onto a rotor free of any channels, rotating the rotor to transfer the analyte to a desorption area and carrying the analyte to an analyzer via an outlet of a second channel of the stator via a carrier gas that is provided via an inlet of the second channel.

BRIEF DESCRIPTION OF THE DRAWINGS

So that the manner in which the above recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
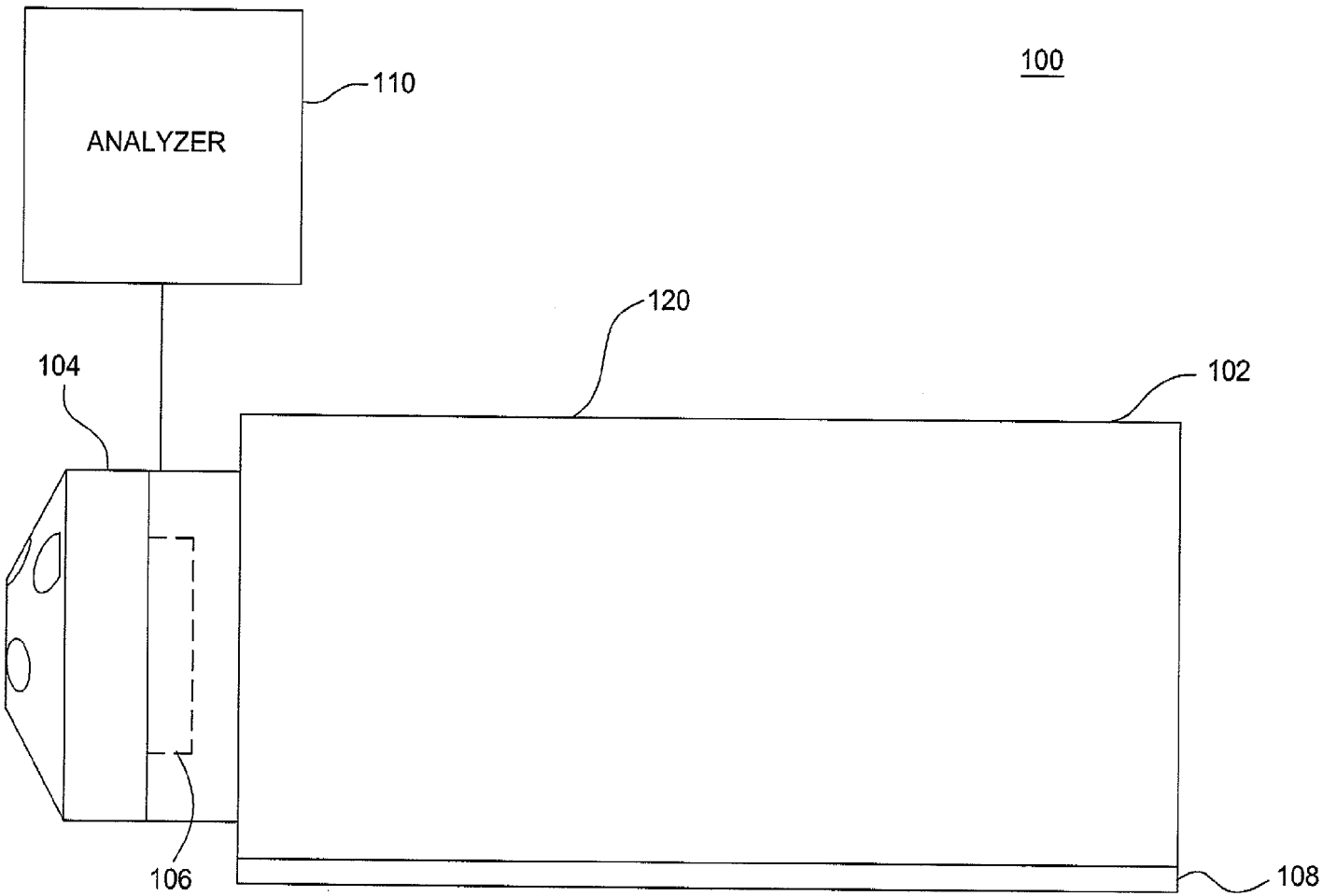
FIG. 1 depicts one embodiment of a system for collecting an analyte underwater.

FIG. 1 illustrates one embodiment of a system 100 for underwater collection of analytes. For example, the system 100 may be used for in-situ underwater mass spectrometry. As a result, analytes do not need to be sent away to a laboratory for further analysis, which can cause the analyte to decompose or be contaminated.

The system 100 provides many other advantages over previous systems for underwater collection of analytes such as the ability to detect non-volatile and semi-volatile compounds as well as volatile compounds. In addition, the design of the system 100 allows the system to be deployed underwater and withstand pressures greater than 5000 pounds per square inch (psi) and handle temperatures up to 330 degrees Celsius (° C.).

In one embodiment, the system 100 includes a rotary interface 120 coupled to an analyzer 110. The analyzer may be any type of analyzer, such as for example, an underwater mass spectrometer, a sensor and the like.

In one embodiment, the rotary interface 120 includes a valve body 102, a rotor 106, a stator 104 and a printed circuit board 108. The printed circuit board 108 may be coupled to the valve body 102 and provide the necessary circuitry and processing components to help control movement and positioning of the rotor 106 and the stator 104. For example, the printed circuit board 108 may include a processor, a memory, one or more input/output devices and a module for having an algorithm that controls the positioning of the rotor 106 and the stator 104.

The design of the rotary interface 120 of the present disclosure makes several key modifications to the stator 104 and the rotor 106 from what is currently available. For example, channels that are typically machined into the rotor 106 are removed. That is, the rotor 106 is completely solid and is free from any channels, holes, openings, etc.

The rotor 106 serves as an adsorption site for analytes that are collected underwater. In one embodiment, the rotor 106 is fabricated from a material that is hydrophobic. That is, the rotor 106 should repel water, while adsorbing the analyte. In one embodiment, the rotor 106 comprises a polymer material. In other embodiments, the rotor 106 may be comprised of other materials, such as stainless steel, silicon carbide, ruby, or ceramic. The rotor 106 may also be coated with a thin layer (e.g., by atomic layer deposition) of material to selectively adsorb analytes.

As a result of the rotor design that allows it to serve as an adsorption site for the analyte, no membrane is needed. This allows the rotary interface 120 to collect and analyze non-volatile and semi-volatile compounds as well as volatile compounds. A heating means, e.g., a laser (e.g., a 655 nanometer (nm) laser), an infrared (IR) light, an ultraviolet (UV) light, a glow discharge (GD), a direct analysis in real-time (DART) or a desorption electrospray ionization (DESI) source and the like, may be used to help collection of the non-volatile and semi-volatile compounds. The membrane interfaces that were previously used required that analytes permeate through the membrane, rather than being adsorbed and desorbed from the same side of a surface. As a result, previous membrane interface devices could not collect and analyze non-volatile and semi-volatile compounds.

The stator 104 is modified to include one or more channels. As the rotor 106 is rotated, the analyte collected by one of the channels in the stator 104 may be transferred to the analyzer 110 via another one of the channels in the stator 104. This process is discussed in further detail below.

Figure 2:
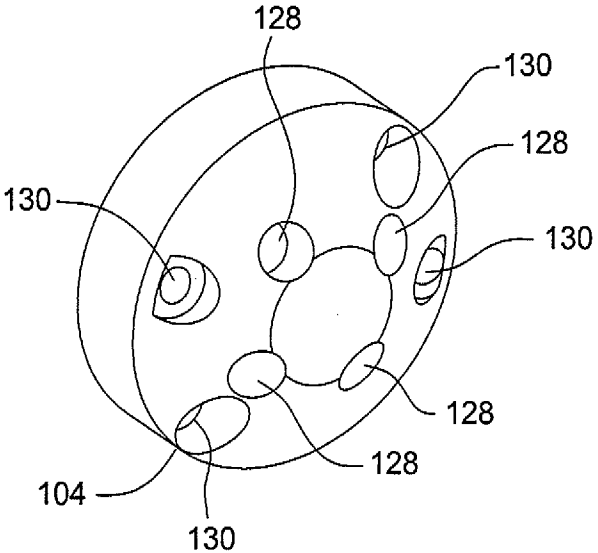
FIG. 2 depicts an isometric view of a stator of a rotary interface.

FIG. 2 illustrates an isometric view of one embodiment of the stator 104. The stator 104 may be fabricated from any material that forms a good seal with the material used to fabricate the rotor 106, while still allowing the rotor 106 to rotate. For example, the stator 104 may be fabricated from stainless steel or a polymer.

In one embodiment, the stator 104 comprises one or more holes 128. Each one of the holes 128 corresponds to an end of a channel. As a result, each one of the holes 128 may serve a different purpose. The stator 104 also includes one or more mounting holes 130. The mounting holes 130 may be used to couple the stator 104 to the valve body 120.

Figure 3:
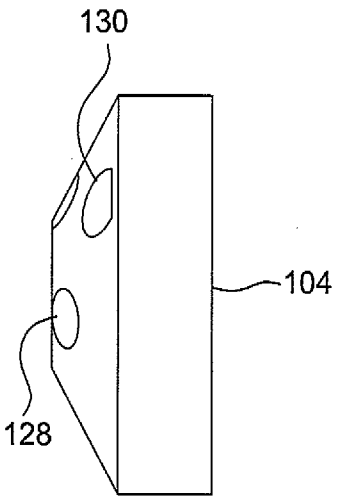
FIG. 3 depicts a side view of the stator.
Figure 4:
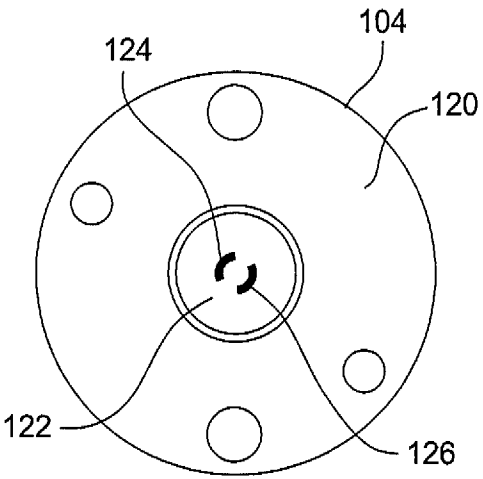
FIG. 4 depicts a bottom view of the stator.

FIG. 3 illustrates a side view of one embodiment of the stator 104. FIG. 4 illustrates a bottom view of one embodiment of the stator 104. As discussed above, one modification to currently available stators is that one or more channels 124 and 126 are cut into a center portion 122 of the stator 104. As discussed above, each end of the channels 124 and 126 may be associated with one of the holes 128 and serves a different purpose.

Figure 5:
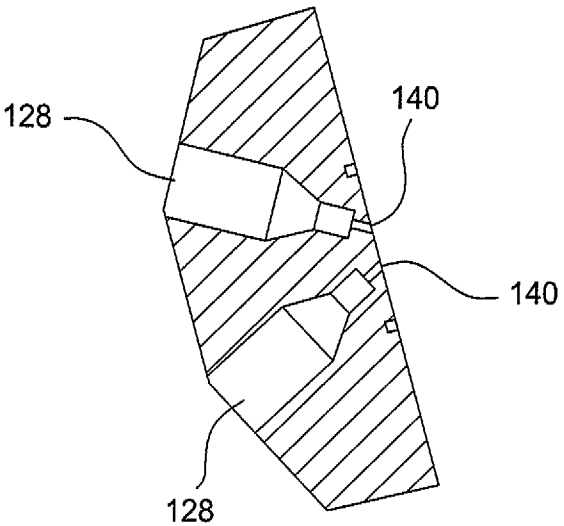
FIG. 5 depicts a cut-away side view of the stator.

FIG. 5 illustrates a side cut away view of one embodiment of the stator 104. FIG. 5 illustrates in more detail how the holes 128 are coupled to an end 140 of the channels 124 and 126. In one embodiment, one end 140 may serve as an inlet and another end 140 may serve as an outlet.

Figure 6:
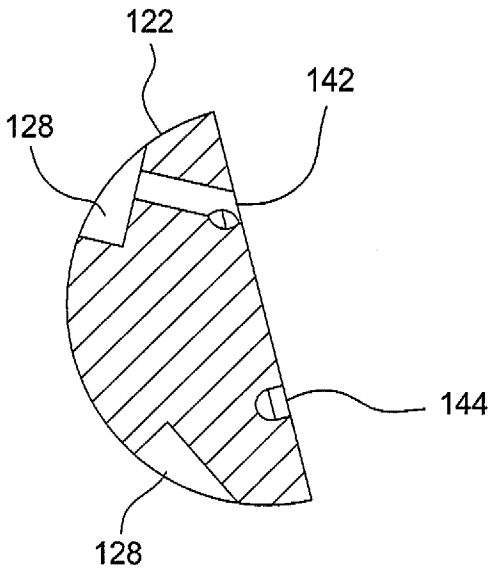
FIG. 6 depicts a cut-away side view of an inner portion of the stator.

FIG. 6 illustrates a side cut away view of one embodiment of the center portion 122 of the stator 104. The center portion 122 also has holes 128. However, the holes 128 of the inner portion do not flow all the way through. Rather, they are blocked and do not communicate with holes 142 and 144. The holes 142 and 144 may be used to provide a carrier gas and move the analyte towards a vacuum of an analyzer 110 using the carrier gas. For example, the carrier gas may enter via hole 142 and the analyte may be carried away via hole 144. In one embodiment, one of the holes (e.g., hole 142) may be considered an inlet and another one of the holes (e.g., hole 144) may be considered an outlet.

In one embodiment, a fiber optic tube may be used to direct a heating means towards the rotor 106. The heating means may be coupled to an inlet (e.g., hole 142) of the center portion 122 of the stator 104.

The heating means is used to heat a vacuum side of the rotor 106 to help evaporate the analyte. In one embodiment, the vacuum side may be defined as a side where the analyzer 110 pulls the analyte from via the vacuum.

The heating means may heat only a localized area of interest on only the vacuum side of the rotor 106 rather than heating the entire rotor 106. This allows the water side of the rotor 106 to remain cool to help adsorption of the analyte out of the water. Providing the heating means allows the rotary interface 120 to be used to collect non-volatile and semi-volatile compounds as well as volatile compounds. The heating means may include, for example, a laser, an infrared (IR) light, an ultraviolet (UV) light, a glow discharge (GD), a direct analysis in real-time (DART) or a desorption electrospray ionization (DESI) source and the like.

Figure 7:
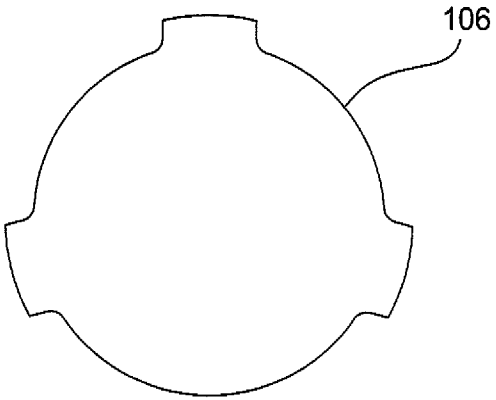
FIG. 7 depicts a top view of a rotor of the rotary interface.
Figure 8:
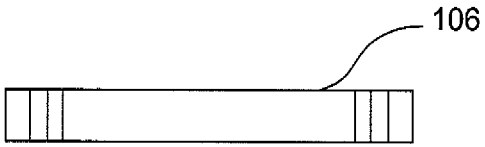
FIG. 8 depicts a side view of the rotor.

FIG. 7 illustrates a top view of one embodiment of the rotor 106. As discussed above, the rotor is completely solid and is free from any channel, holes, openings, etc. This is illustrated by the top view of the rotor 106 in FIG. 7. FIG. 8 illustrates a side view of one embodiment of the rotor 106.

Figure 9:
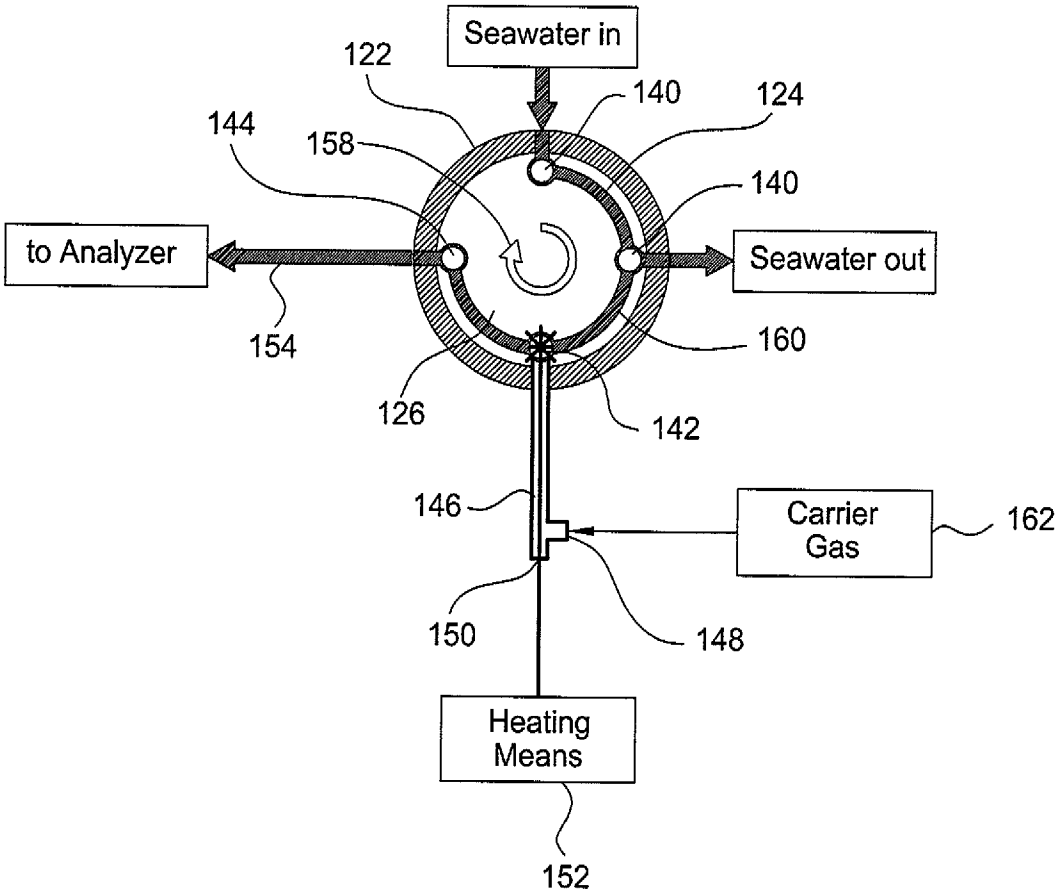
FIG. 9 depicts one embodiment of how the rotary interface collects an analyte underwater.

FIG. 9 illustrates one embodiment of how the rotary interface 120 is operated to collect an analyte underwater. FIG. 9 illustrates the center portion 122 and may be viewed as looking up at the rotor 106 and the stator 104. The rotor 106 may be considered "transparent" in FIG. 9 for the purpose of illustration to simultaneously illustrate the channels and openings of the stator 104 relative to the rotor 106.

In one embodiment, seawater flows in via a hole 128 into the stator 104 and contacts the rotor 106 via one end 140 of the channel 124. As the seawater flows through the channel 124, the analyte is adsorbed into an adsorption region 160 of the rotor 106. As discussed above, the rotor 106 should be fabricated from a material that is hydrophobic, for example a polymer, to repel the seawater away while adsorbing the analyte.

In one embodiment, a fiber optic tube 146 may be coupled to an inlet hole 142 to provide a carrier gas 162 via an opening 148 and a heating means 152, e.g., a laser, via an opening 150. The fiber optic tube 146 may be coupled to the opening 142 of the channel 126. The heating means 152 may be used to heat the vacuum side of the rotor 106 to help evaporate the analyte. This allows the rotary interface 120 to be used to collect non-volatile and semi-volatile compounds as well as volatile compounds. In one embodiment, the heating means may be a laser (e.g., a 655 nanometer (nm) laser), an infrared (IR) light, an ultraviolet (UV) light, a glow discharge (GD), a direct analysis in real-time (DART) or a desorption electrospray ionization (DESI) source and the like.

The analyte evaporates towards the vacuum side of the rotor 106 and the carrier gas carries the analyte. After a predetermined amount of time or based upon a monitoring of the amount of analyte that is collected, the rotor 106 may be rotated, as shown by arrow 158, such that the ends of the channels 124 and 126 are aligned with different locations on the rotor. By rotating the rotor 106, the carrier gas carries the analyte towards an outlet hole 144 of the channel 126 towards a vacuum of an analyzer as illustrated by arrow 154. In addition, the seawater flows out of another end 140 of the channel 124 and another hole 128 back into the sea. In one embodiment, the rotor could also be rotated continuously during analysis.

Figure 10:
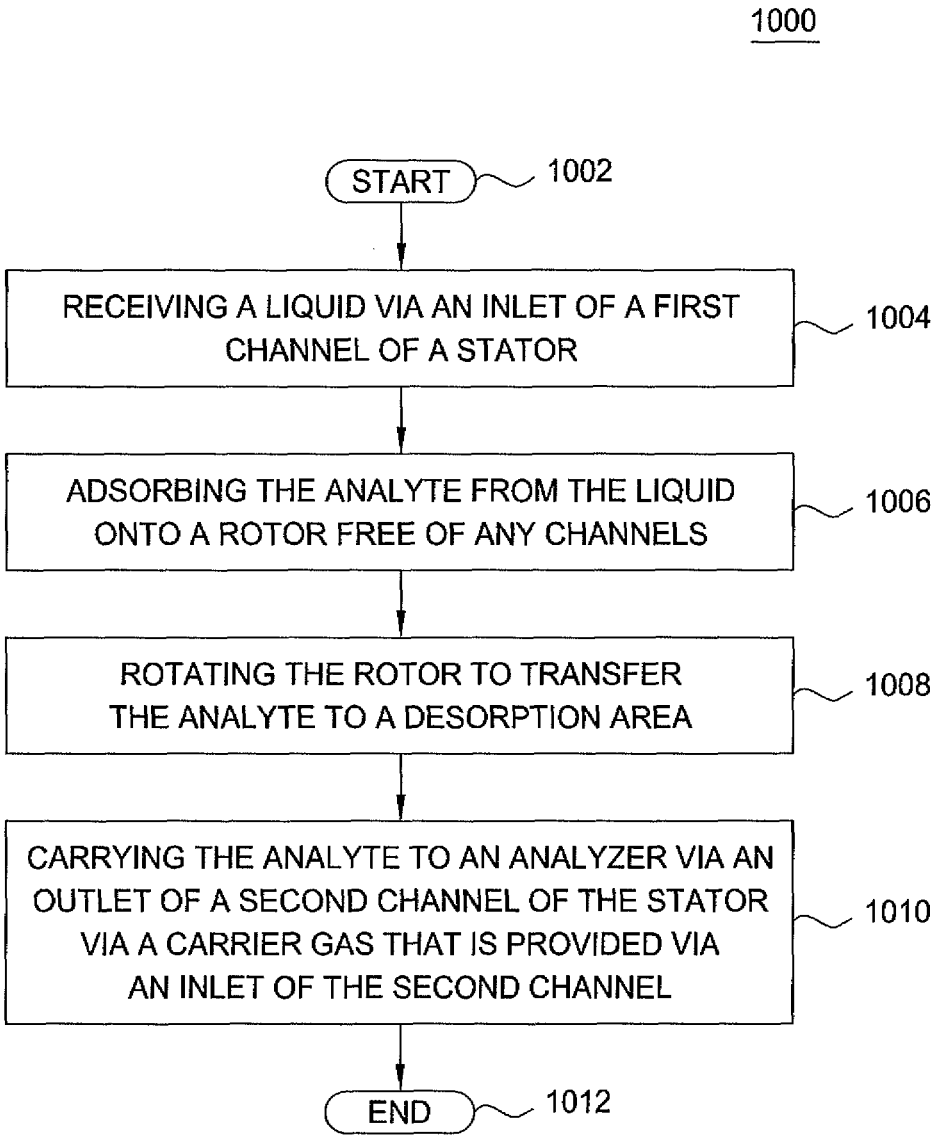
FIG. 10 depicts a flow diagram of one embodiment of a method for collecting an analyte underwater.

FIG. 10 illustrates a flow diagram of one embodiment of a method 1000 for collecting an analyte in a liquid, for example underwater, as described above. In one embodiment, the method 1000 may be carried out by the system 100 illustrated in FIG. 1. The method 1000 begins at step 1002.

At step 1004, the method 1000 receives a liquid via an inlet of a first channel of a stator. In one embodiment, the liquid may be water. For example, the rotary interface 120 may be placed underwater in a water-proof housing. The water may flow into a hole 128 of the stator 104.

At step 1006, the method 1000 adsorbs the analyte from the liquid onto a rotor free of any channels. As discussed above, the rotor 106 should be completely solid and free of channels, holes, openings, etc.

In one embodiment, a heating means may be used to help evaporate the analyte into a carrier gas. This allows the rotary interface 120 to collect non-volatile and semi-volatile compounds for analysis as well as volatile compounds. In one embodiment, the heating means may be a laser (e.g., a 655 nanometer (nm) laser), an infrared (IR) light, an ultraviolet (UV) light, a glow discharge (GD), a direct analysis in real-time (DART) or a desorption electrospray ionization (DESI) source and the like.

At step 1008, the method 1000 rotates the rotor to transfer the analyte to a desorption area. By rotating the rotor 106, different ends of the channels in the stator 104 may be aligned with different locations of the rotor 106. For example, rotating the rotor 106 allows the liquid (e.g. water) to exit out of an outlet of the first channel 124 of the stator 104 and allows the analyte to be carried out to an analyzer 110.

At step 1010, the method 1000 carries the analyte to an analyzer via an outlet of a second channel of the stator via a carrier gas that is provided via an inlet of the second channel. In one embodiment, the analyzer 110 may be a mass spectrometer, e.g., a linear quadrupole mass analyzer, an ion trap mass spectrometer, tandem mass spectrometer, and the like. In one embodiment, the carrier gas may be any inert gas such as, for example, helium, argon, nitrogen and the like. The type of carrier gas may depend on the type of analyzer that is being used. The method 1000 ends at step 1012.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A rotary interface for collecting an analyte, comprising:
- a valve body;
- a rotor coupled to the valve body, wherein the rotor is channel-free, wherein the rotor adsorbs the analyte while repelling water; and
- a stator coupled to the rotor, wherein the stator comprises a first channel and a second channel, wherein the first channel comprises an inlet for receiving a liquid and an outlet for expelling the liquid, wherein a carrier gas is provided via an inlet of the second channel and an outlet of the second channel is coupled to an analyzer.

2. The rotary interface of claim 1, further comprising:
- a heat source coupled to an inlet of the second channel.

3. The rotary interface of claim 2, wherein the heat source comprises a laser.

4. The rotary interface of claim 1, wherein the carrier gas comprises an inert gas.

5. The rotary interface of claim 4, wherein the carrier gas comprises helium.

6. The rotary interface of claim 1, wherein the rotor comprises a material that is hydrophobic.

7. The rotary interface of claim 6, wherein the rotor comprises at least one of: a polymer, stainless steel, silicon carbide, ruby or ceramic.

8. The rotary interface of claim 1, wherein the rotor is coated with a thin layer of a material that selectively adsorbs the analyte.

9. The rotary interface of claim 1, wherein the rotary interface collects the analyte underwater at a pressure greater than 5000 pounds per square inch (psi).

10. The rotary interface of claim 1, wherein the analyzer comprises a mass spectrometer.

11. A system for performing underwater mass spectrometry, comprising:
- a mass spectrometer; and
- a rotary interface coupled to the underwater mass spectrometer, the rotary interface, comprising:
  - a valve body;
  - a rotor coupled to the valve body, wherein the rotor is channel-free, wherein the rotor adsorbs the analyte while repelling water; and
  - a stator coupled to the rotor, wherein the stator comprises a first channel and a second channel, wherein the first channel comprises an inlet for receiving a liquid and an outlet for expelling the liquid, wherein a carrier gas is provided via an inlet of the second channel and an outlet of the second channel is coupled to an analyzer.

12. The system of claim 11, further comprising:
- a heat source coupled to an inlet of the second channel, wherein the heat source comprises a laser.

13. The system of claim 11, wherein the carrier gas comprises helium.

14. The system of claim 11, wherein the rotor comprises a material that is hydrophobic.

15. The system of claim 14, wherein the rotor comprises at least one of: a polymer, stainless steel, silicon carbide, ruby or ceramic.

16. The system of claim 11, wherein the rotor is coated with a thin layer of a material that selectively adsorbs the analyte.

17. The system of claim 11, wherein the rotary interface collects the analyte underwater at a pressure greater than 5000 pounds per square inch (psi).

18. A method for collecting an analyte underwater, comprising:
- receiving a liquid via an inlet of a first channel of a stator;
- adsorbing the analyte from the liquid onto a rotor free of any channels, wherein the analyte is adsorbed while the liquid is repelled from the rotor;
- rotating the rotor to transfer the analyte to a desorption area; and
- carrying the analyte to an analyzer via an outlet of a second channel of the stator via a carrier gas that is provided via an inlet of the second.

* * * * *